US006082052A

United States Patent [19]

Kahn

[11] Patent Number: 6,082,052

[45] Date of Patent: Jul. 4, 2000

[54] RAIN GUTTER

[76] Inventor: Gene Kahn, 2607 E. Beverly Dr., Tucson, Ariz. 85716

[21] Appl. No.: 09/215,882

[22] Filed: Dec. 18, 1998

[51] Int. Cl.[7] ..... E04D 13/64

[52] U.S. Cl. ..... 52/16; 52/11; 52/12; 52/15

[58] Field of Search ..... 52/16, 11, 13, 52/14, 15, 12

[56] References Cited

U.S. PATENT DOCUMENTS

| | | | |
|---|---|---|---|
| 3,248,827 | 5/1966 | Hardy | 52/11 |
| 4,183,368 | 1/1980 | Husted | 52/16 X |
| 4,304,498 | 12/1981 | George | 52/16 X |
| 4,436,518 | 3/1984 | Buss | 52/12 X |
| 5,197,237 | 3/1993 | Owens | 52/11 |
| 5,752,347 | 5/1998 | Osborn | 52/12 X |
| 5,893,239 | 4/1999 | Leahy | 52/16 X |

*Primary Examiner*—Carl D. Friedman
*Assistant Examiner*—Phi Dieu Tran A
*Attorney, Agent, or Firm*—Mark E. Ogram P.C.

[57] ABSTRACT

A rain gutter and system created therewith in which the gutter is easily cleaned using a traditional garden hose from the ground level. The gutter has an upper lip and a lower lip between which is a continuously curved surface. This continuous curved surface, such as elliptical, provides a surface over which a stream of water from a garden hose and caught by the upper lip portion flushes debris over the lower lip. In some embodiments of the invention, vanes are used to help maintain the stream of water from spreading to obtain the maximal cleaning affect. In this manner, the gutter is easily and simply cleaned of leaves and other debris by directing a garden hose's stream of water against the upper lip.

14 Claims, 4 Drawing Sheets

RAIN GUTTER

BACKGROUND OF THE INVENTION

This invention generally to rain disposal system and more particularly to rain gutters.

Rain gutters are used on the vast majority of houses located in the suburbs. The shape and purpose has remained the same since their first inception. A channel is formed in the shape of a half-circle and is hung upside down below the roof line to collect run-off and re-direct the water to a down spout which directs the run-off to a convenient disposal location.

During the year though, leaves and other debris tend to collect in the rain gutter. As this debris collects, the efficiency of the gutter diminishes, and if the debris collects in the down-spout, then the entire purpose of the gutter can be avoided.

The cleaning of rain gutters rates as the biggest bane for the homeowner. Cleaning rain gutters entails the use of a ladder which is moved steadily along the rain-gutter. At each stop of the ladder, the homeowner climbs to the top of the ladder and manually removes the leaves and debris from the rain-gutter. The task is dirty, tedious, and extremely laborious.

It is clear that there is a need for an improved rain-gutter that permits easy and efficient cleaning.

SUMMARY OF THE INVENTION

The invention creates a highly improved rain gutter and system. As noted earlier, the rain gutter is used in many buildings to collect the run-off water (and by extension leaves and dirt from the roof) and to direct this flow to a down spout where the flow is exhausted. This invention creates a gutter which creates a highly improved system since the gutter is easily cleaned using a traditional garden hose from the ground level.

The gutter of this invention utilizes an upper lip and a lower lip between which is a continuously curved surface. The upper lip is positioned to allow run-off from the roof to pass and fall, where it is caught by the lower lip. The run-off from the falls over the upper lip is caught by the lower lip. The run-off is collected at a lower portion of the continuously curved surface and flows to a down spout where the flow is exhausted in a traditional manner.

Ideally the curved surface between the upper lip and the lower lip is elliptical in shape to provide a smooth surface over which water will pass easily.

The power of the present invention is derived from the configuration of the upper lip relative to the lower lip. The upper lip is accessible to a water stream from below. As a water stream (such as directed from a garden hose from the ground) strikes the curved surface near the upper lip, the stream, due to its natural momentum, streams over the curved surface. Since the stream of water is substantially perpendicular to the center line of the gutter. The steam flushes the debris in its path over the curved surface to be swept over the lower lip.

As the water stream makes this passage, it drives leaves, dirt and other debris ahead of itself to be "pushed" over the lower lip. In this manner, the curved surface provides a surface over which a stream of water from a garden hose caught by the upper lip portion flushes debris over the lower lip.

In some embodiments of the invention, vanes are used to help maintain the stream of water from spreading to obtain maximal cleaning affect. The vanes are ideally perpendicular to the surface of the curve and also extend perpendicular to the lips. This arrangement firmly directs the stream of water in a flow pattern which sweeps the curved surface clean by driving the debris over the lower lip.

Those of ordinary skill in the art readily recognize other arrangements for the vanes which will accomplish this function.

In more detail, the present invention creates a rain-gutter which has an approximately elliptical cross section. Positioned such that a center line of the ellipse is substantially parallel with the roof line (only lower), a section of the ellipse is open allowing water to be collected and disposed in the normal operation.

For the cleaning operation, a directed stream of water, engages an upper lip of the ellipse, sweeps around the curved surface, and flings debris from the rain-gutter. In practice, the home-owner need only spray a stream of water against the top rim of the rain gutter to clean the gutter from debris.

No longer does the home-owner need to use a ladder or to handle the debris by hand. The debris is quickly and easily removed using a simple garden hose.

In some applications, an extension wand is connected to the garden hose to allow the home-owner the ability to discharge the stream more closely to the rain-gutter.

In still another embodiment, the rain-gutter of this invention includes a water pipe located at the top of the ellipse. This water pipe is equipped with nozzles allowing the homeowner to merely connect the pipe to a garden hose and thereby clean the entire rain-gutter in one operation.

The preferred embodiment of the invention is manufactured from plastics, although those of ordinary skill in the art readily recognize that the rain-gutter of this invention can be manufactured from a variety of materials including, but not limited to, sheet metal, and tin.

The invention, together with various embodiments thereof will be more fully explained by the accompanying drawings and their associated descriptions.

DRAWINGS IN BRIEF

Figure 5A:
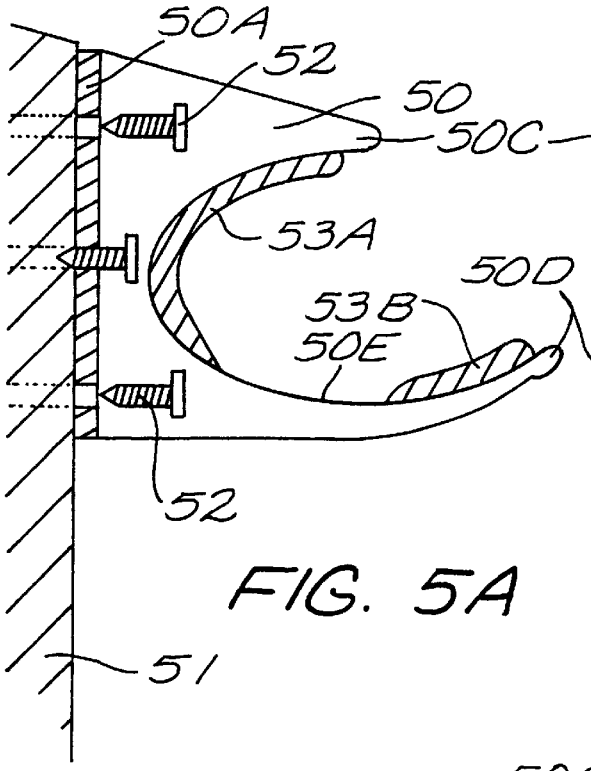
Figure 5B:
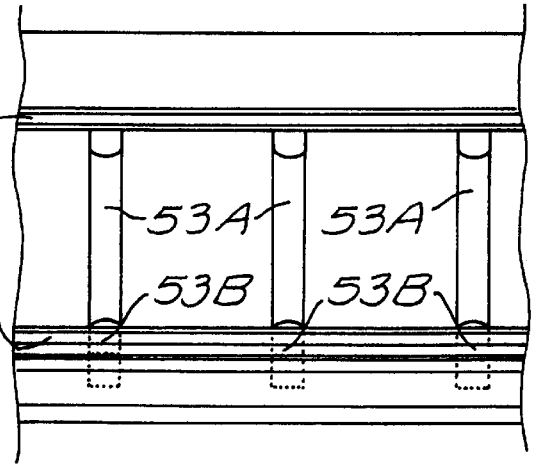
Figure 5C:
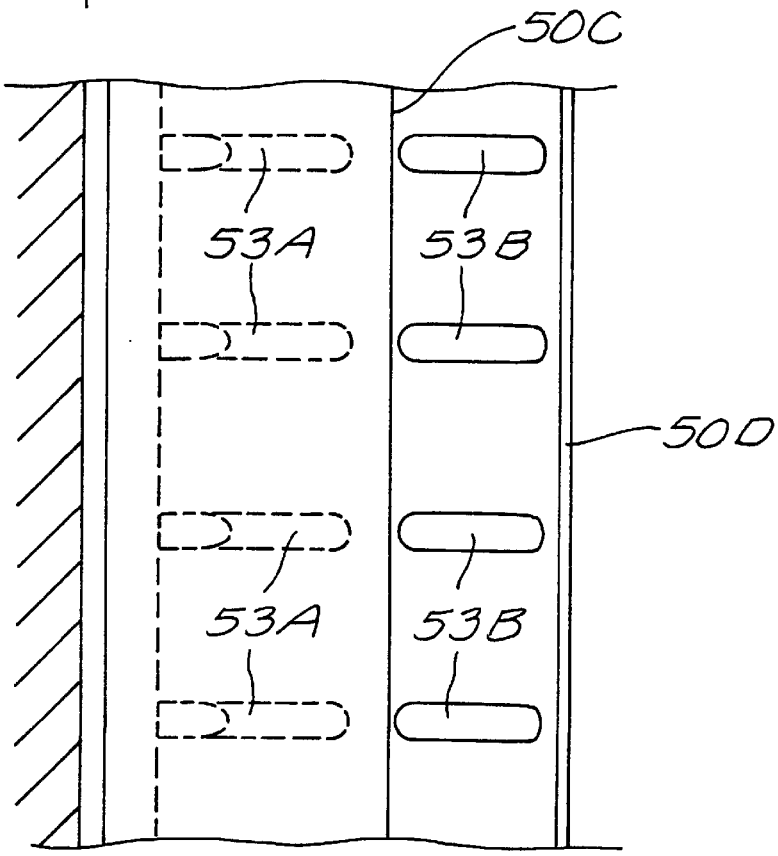

FIGS. 5A, 5B, and 5C, are side, frontal, and top views respectively of the preferred embodiment of the invention.

Figure 6:
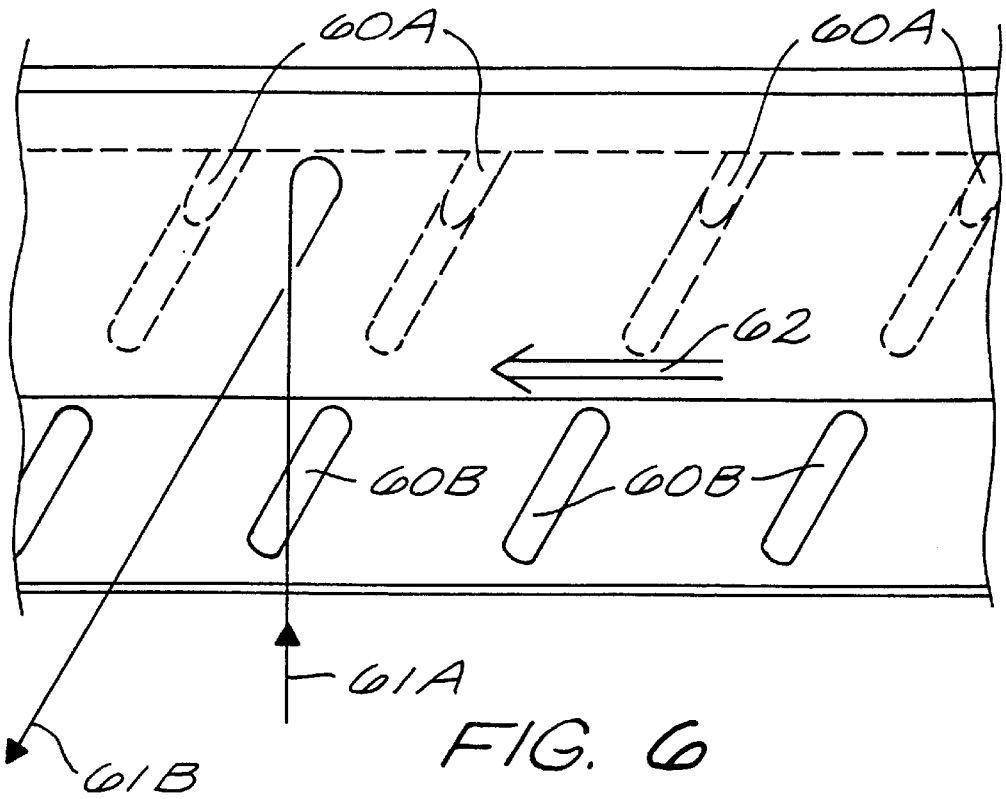

FIG. 6 illustrates the vane arrangement for an alternative embodiment of the invention.

Figure 7:
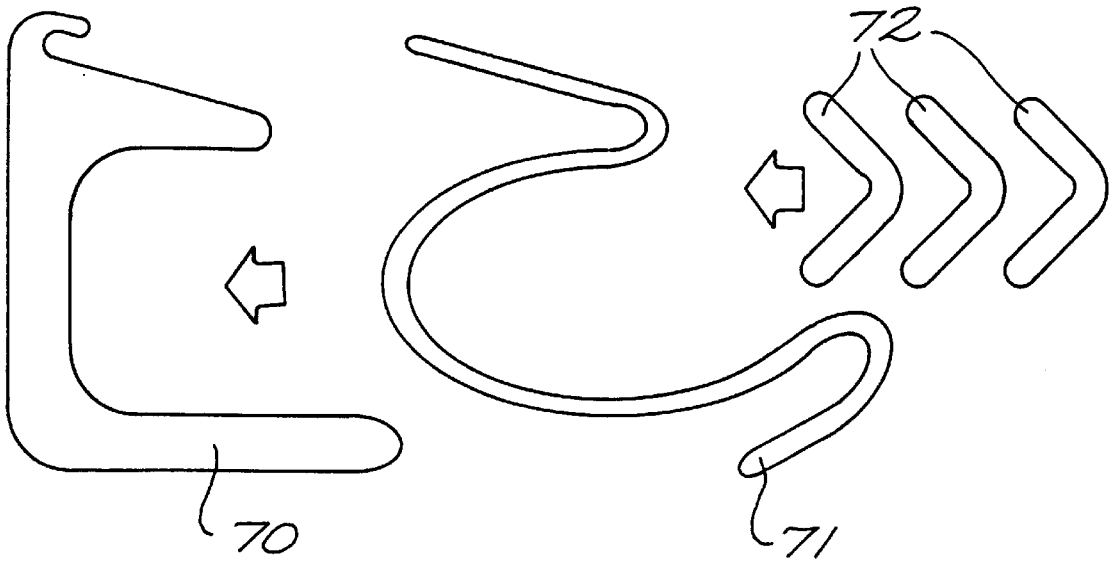

FIG. 7 shows an embodiment of the invention which is assembled in kit form.

DRAWINGS IN DETAIL

Figure 1:
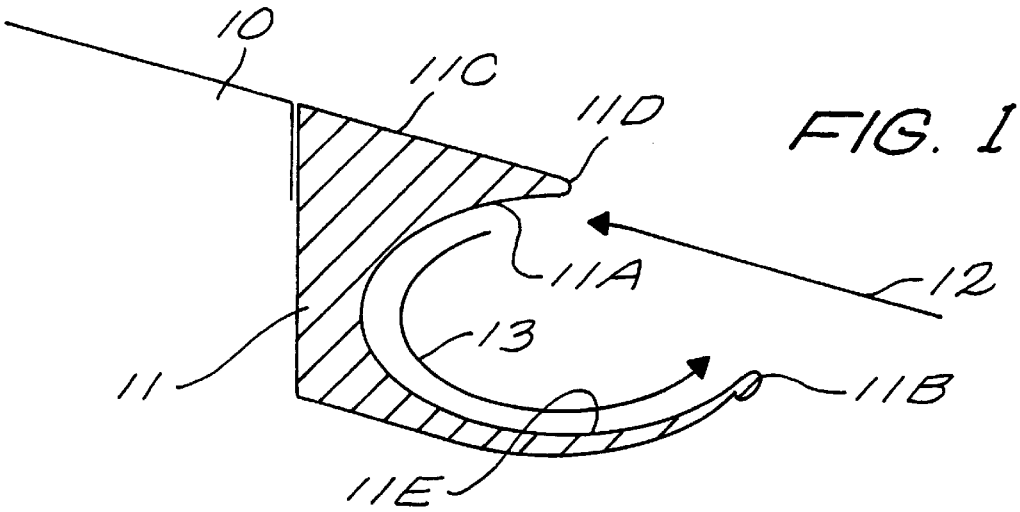
FIG. 1 illustrates the basic concept behind the present invention showing the elliptical gutter and the direction of the water spray from the hose to clean the effluent from the gutter.

FIG. 1 illustrates the basic concept behind the present invention showing the elliptical gutter and the direction of the water spray from the hose to clean the effluent from the gutter.

Gutter 11 is secured to the edge of roof 10 so that run-off from roof 10 passes over slope 11C and falls off upper lip 11D. Since lower lip 11B extends past upper lip 11D, the falling water is caught and flows to the down spout (not shown in this illustration) along lower channel surface 11E.

The inside of gutter 11 is a smooth continuous surface contoured in an elliptical shape. This shape permits the ready cleaning of debris which may collect along lower channel surface 11E. Water stream 12, such as from a garden hose, is directed against the surface 11A proximate to the upper lip 11D. The water striking surface 11A is swept around the interior surface as indicated by arrow 13 to wash the debris/effluent over lower lip 11B.

In this manner, gutter 11 is easily cleaned using a simple spray of water to remove the debris collected therein.

Figure 2:
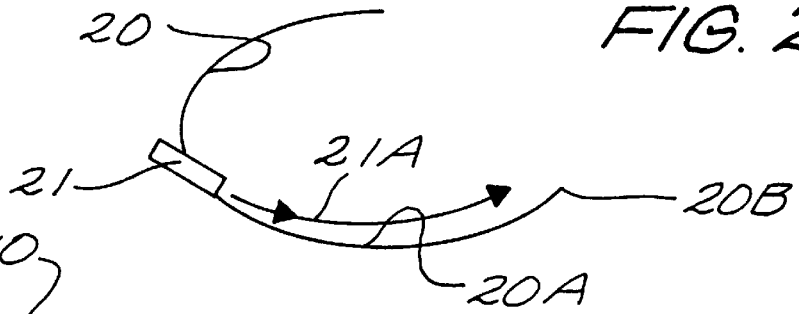
FIG. 2 illustrates an embodiment of the invention which uses a built in power spray nozzle to clean the rain gutter.

FIG. 2 illustrates an embodiment of the invention which uses a built in power spray nozzle to clean the rain gutter.

Showing only the interior curved surface 20, in this embodiment a power spray nozzle 21 is manufactured into the gutter. Spray nozzle 21 is adjusted to cause spray 21A of water through the bottom (i.e. the channel portion) 20A of the gutter. This spray of water 21A forces the debris collected in bottom 20A to be swept over lip 20B.

This embodiment permits the user to activate spray nozzle 21 via a valve (not shown) to periodically clean the gutter.

Figure 3:
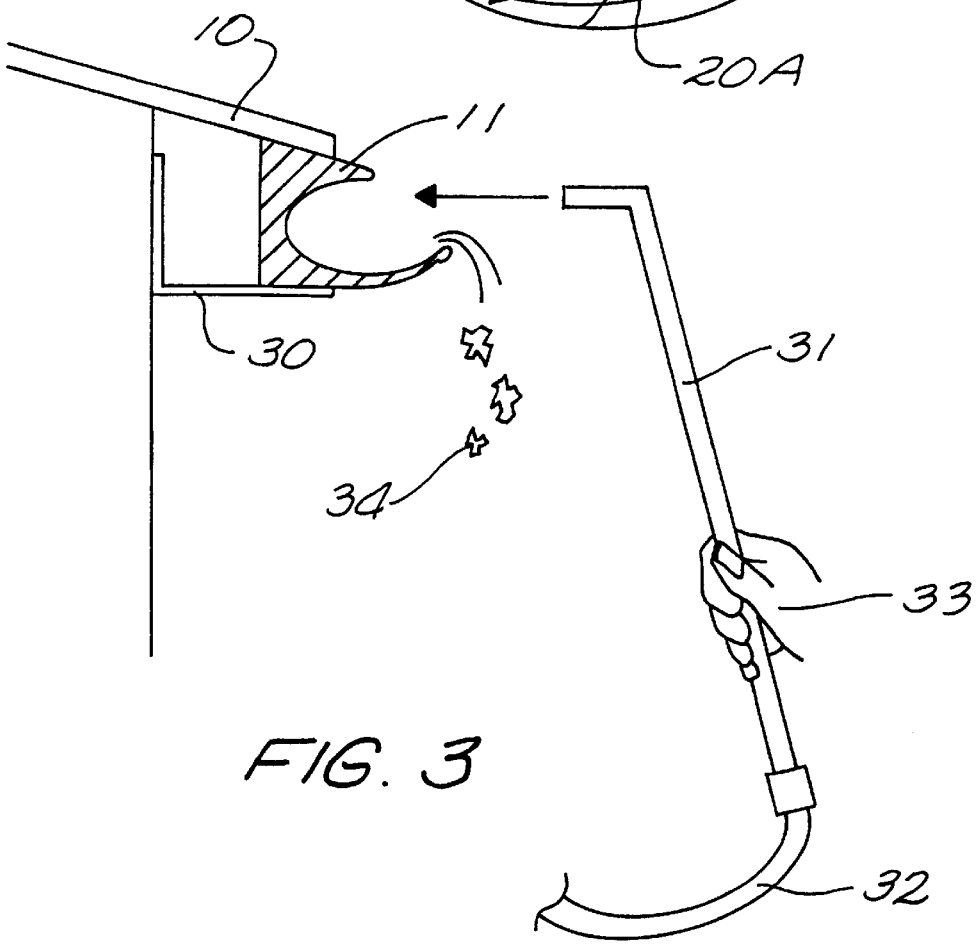
FIG. 3 illustrates an embodiment of the invention in which the homeowner uses a wand to provide a more focused spray of water into the gutter.

FIG. 3 illustrates an embodiment of the invention in which the homeowner uses a wand to provide a more focused spray of water into the gutter.

In this embodiment, gutter 11 has been attached to the building and roof 10 using bracket 30 which is bolted onto the building. As noted earlier, gutter 11 is configured having a smooth continuous surface. Water from wand 31 as directed by user 33 creates a cleaning spray of water from garden hose 32 against this smooth surface to wash away the leaves and dirt 34 which had collected in gutter 11.

Wand 31 allows a user to direct the spray of water exactly against gutter 11 without having to use ladders or rely upon directing the spray of water from the ground.

Figure 4A:
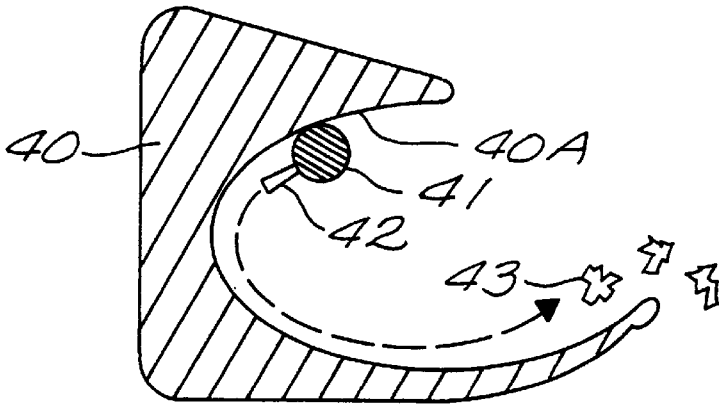
FIG. 4A illustrates an embodiment of the invention in which a built in pipe with nozzle is used to clean the debris from the rain gutter.

FIG. 4A illustrates an embodiment of the invention in which a built in pipe with nozzle is used to clean the debris from the rain gutter.

Gutter 40 is equipped with pipe 41 which is adapted to carry water. Pipe 41 is positioned on surface 40A which is in a protected area of gutter 40.

Water from pipe 41 is sprayed from nozzle 42 in a direction to pass over the smooth surface of gutter 40 to wash away the debris 43.

Figure 4B:
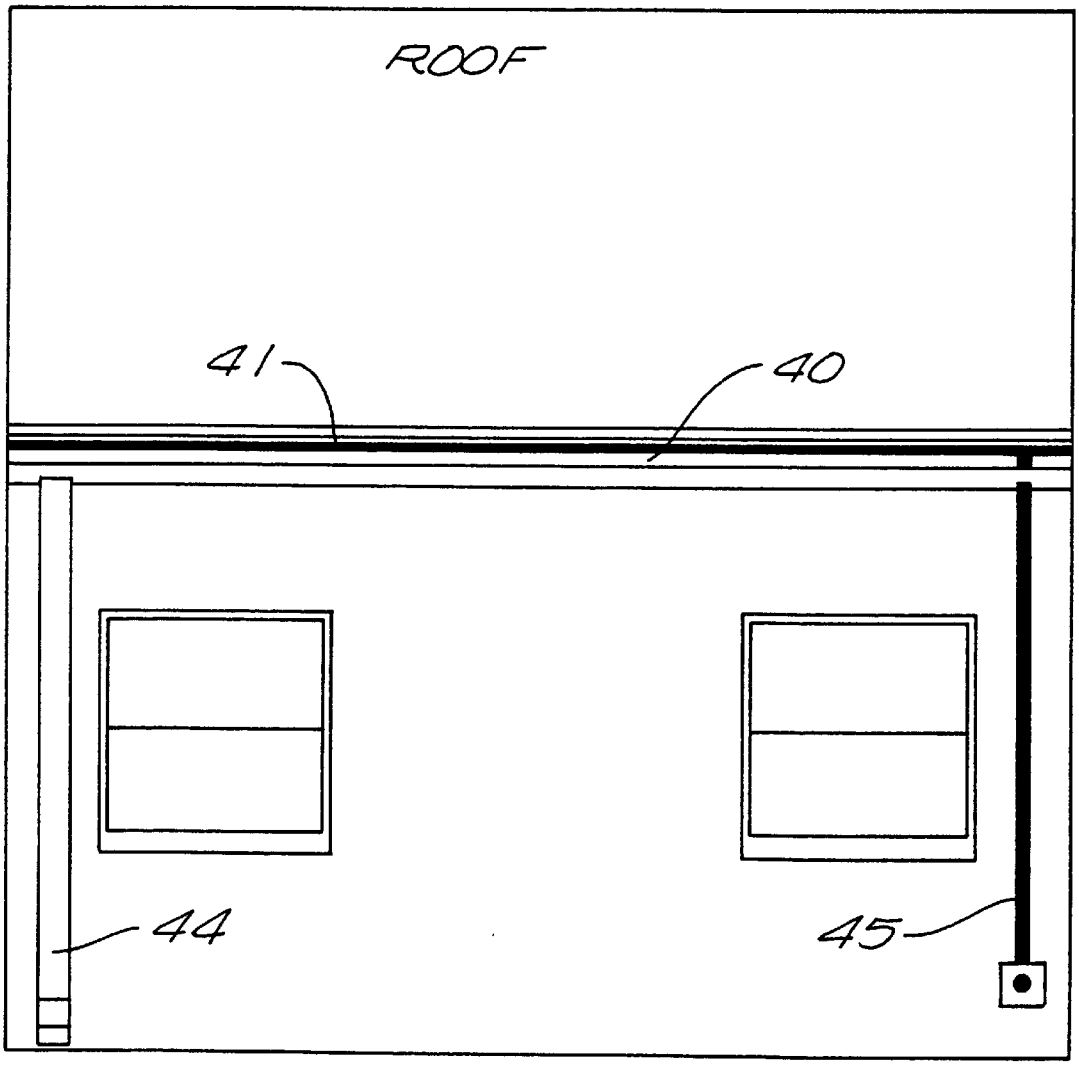
FIG. 4B is a side view of a house showing the embodiment of FIG. 4A and illustrating the flush pipe which accepts a garden hose to supply water for the spray nozzle used to clean the rain gutter.

FIG. 4B is a side view of a house showing the embodiment of FIG. 4A and illustrating the flush pipe which accepts a garden hose to supply water for the spray nozzle used to clean the rain gutter.

When gutter 40 is installed onto the house, a down spout 44 is attached thereto to exhaust run-off into the usual disposal system. Water is communicated to pipe 41 (described in FIG. 4A) using flush pipe 45. Flush pipe 45, in this embodiment, is connectable to a garden hose to supply the water which is emitted from nozzle 42 (shown in FIG. 4A).

In other embodiments of the invention, flush pipe 45 is connected to a water source and a valve is used to selectively charge pipe 41, and by extension, clean gutter 40.

FIGS. 5A, 5B, and 5C, are side, frontal, and top views respectively of the preferred embodiment of the invention.

The various components are best illustrated in FIG. 5A. Gutter 50 is secured to building 51 using bracket 50A and screws 52. The installed gutter 50 in configured so that run-off from building 50 falls over upper lip 50C and is caught to be carried away for disposal (note, lower lip 50D extends past upper lip 50C so that the run-off is properly caught). Lower channel surface 50E is used to transport the run-off to the down spout (not shown).

To facilitate the cleaning process as outlined above, upper vanes 53A and lower vanes 53A are positioned to direct the water spray along pre-defined paths (see FIGS. 5B and 5C). In FIG. 5C, only the vanes are illustrated to facilitate the illustration.

Upper vanes 53A and lower vanes 53B, in this embodiment, extend perpendicular (or substantially perpendicular) to the interior surface of gutter 50. Further, in this embodiment, upper vanes 53A run perpendicular to the upper lip 50C; lower vanes 53B run perpendicular to lower lip 50D. Further, in this embodiment, upper vanes 53A and lower vanes 53B are aligned with each other.

This arrangement of vanes 53A and 53B form segmented "causeways" so that the water stream is confined between two adjoining sets of vanes. Since the water stream is confined to a specific "zone" or "causeway", the stream is prevented from "spreading out" so that maximal cleaning affect is obtained. In this manner, the full affect of the water spray is obtained.

In the preferred embodiment, the distance between vanes is approximately 1.5 inches(substantially the width of a hose spray); those of ordinary skill in the art readily recognize that other distances are also available.

FIG. 6 illustrates the vane arrangement for an alternative embodiment of the invention.

In this embodiment of the invention, upper vanes 60A and lower vanes 60B extend at a slope from their respective lips of the gutter. In this embodiment, the slope taken by the upper vanes 60A point down stream of the run-off water flow 62. In other embodiments, the slope is reversed.

In this embodiment, upper vanes 60A are aligned with lower vanes 60B to form the "causeways" for the stream of water. As the water stream 61A is directed against between two upper vanes 60A, the water is trapped between the two upper vanes 60A and re-directed at an angle to exit 61B at a direction not-aligned with the initial flow 61A; hence, missing the incoming water stream.

In this fashion, the debris being washed away is kept from the incoming water flow so that no disruption of the washing affect occurs.

FIG. 7 shows an embodiment of the invention which is assembled in kit form.

In this kit, bracket/form 70 is provided and is attached to the building. An interior channel 71 is then pressed into bracket/form 70. Interior channel 71 is ideally manufactured from sheet metal.

Vanes 72, ideally made from plastic, are then secured to the channel 71. Vanes 72 are secured in a variety of manners including, but not limited to, glue and snap fasteners.

This embodiment permits the channel to be removed and replaced as it ages and develops leaks.

It is clear that the present invention creates a highly improved rain gutter and method of cleaning such.

What is claimed is:

1. A rain gutter combination comprising:

a) a channel member having, 1) mounting means for securing said channel member to an edge of a roof; and, 2) a catch basin having a continuously curved surface extending between an upper lip and a lower lip and forming a catch basin therebetween; when said channel member is installed, said lower lip extending past said upper lip to collect runoff from said roof, said continuously curved surface proximate to said upper lip configured to direct a spray of water from below said channel member impacting said continuously curved surface proximate to said upper lip into said continuously curved surface, said curved surface being elliptical in shape;

b) a down spout extending substantially perpendicular to said channel member, said down spout directs water from the catch basin of said channel member to an exhaust point;

c) said channel member further includes at least two upper vanes, each of said upper vanes extending substantially perpendicular to said curved surface beginning proximate to said upper lip.

2. The rain gutter combination according to claim 1, wherein said at least two upper vanes taper to a point proximate to a lower channel in said curved surface.

3. The rain gutter combination according to claim 1, wherein said upper vanes are perpendicular to said upper lip.

4. The rain gutter combination according to claim 1, wherein said upper vanes are at an angle to said upper lip directed towards said down spout.

5. The rain gutter combination according to claim 1, wherein said channel member further includes at least two lower vanes, each of said lower vanes beginning proximate to said lower lip and extending substantially perpendicular to said curved surface.

6. The rain gutter combination according to claim 5, wherein said at least two lower vanes taper to a point proximate to a lower channel in said curved surface.

7. The rain gutter combination according to claim 5, wherein said lower vanes are perpendicular to said lower lip.

8. The rain gutter combination according to claim 5, wherein said lower vanes are at an angle to said lower lip directed towards said down spout.

9. The rain gutter combination according to claim 8, wherein each of said lower vanes are aligned with one of said upper vanes.

10. A rain gutter for use on a roof of a building, said rain gutter comprising:

a) mounting means for securing said rain gutter to an edge of said roof; and, b) a continuously curved surface extending between an upper lip and a lower lip and forming a catch basin therebetween, when said rain gutter is installed, said lower lip extending past said upper lip, said continuously curved surface proximate to said upper lip configured to direct a spray of water impacting thereon, across said continuously curved surface;

c) wherein said curved surface being elliptical in shape;

d) at least two sets of upper and lower vanes extending substantially perpendicular to said curved surface.

11. The rain gutter according to claim 10, wherein said upper and lower vanes do not connect to each other.

12. The rain gutter according to claim 11, wherein each of said lower vanes are aligned with one of said upper vanes.

13. A rain disposal system comprising:

a) a channel member having, 1) mounting means for securing said channel member to an edge of a roof; and, 2) a catch basin having a continuously curved surface extending between an upper lip and a lower lip and forming a catch basin therebetween; when said channel member is installed, said lower lip extending past said upper lip to collect runoff from said roof, said continuously curved surface proximate to said upper lip configured to direct a spray of water from below said channel member impacting said continuously curved surface proximate to said upper lip into said continuously curved surface, said curved surface being elliptical in shape;

b) a down spout extending substantially perpendicular to said channel member, said down spout directs water from the catch basin of said channel member to an exhaust point;

d) a hose located below said channel member and adapted to be directed by a user;

e) said channel member further includes at least two upper vanes, each of said vanes configured to direct said stream of water over said continuously curved surface and over said lower lip.

14. The rain disposal system according to claim 13, wherein said channel member further includes at least two lower vanes configured to act in concern with said upper vanes.

* * * * *